United States Patent [19]

Adamski et al.

[11] Patent Number: 4,976,749

[45] Date of Patent: Dec. 11, 1990

[54] AIR FILTER AND PARTICLE REMOVAL SYSTEM

[75] Inventors: Joseph R. Adamski; John S. Sklenak, both of Sudbury, Mass.

[73] Assignee: Raytheon Company, Lexington, Mass.

[21] Appl. No.: 501,347

[22] Filed: Mar. 26, 1990

Related U.S. Application Data

[63] Continuation of Ser. No. 342,151, Apr. 24, 1989, abandoned.

[51] Int. Cl.[5] ..... B03C 3/00

[52] U.S. Cl. ..... 55/6; 55/123; 55/131; 55/139; 55/150; 55/354; 55/390; 55/524

[58] Field of Search ..... 55/131.6, 123, 150, 55/139, 154, 524, 387, 354, 390

[56] References Cited

U.S. PATENT DOCUMENTS

| | | | |
|---|---|---|---|
| 768,450 | 8/1904 | Hardie | 55/123 |
| 2,579,440 | 12/1951 | Palmer | 55/138 |
| 2,973,828 | 3/1961 | Engle | 55/278 |
| 2,974,747 | 3/1961 | Coolidge | 55/154 |
| 3,375,638 | 4/1968 | Dungler | 55/116 |
| 3,482,375 | 12/1969 | Ellingen | 55/151 |
| 3,537,238 | 11/1970 | Dungler | 55/131 |
| 3,581,468 | 6/1971 | Gourdine et al. | 55/114 |
| 3,626,668 | 12/1971 | Cardiff | 55/139 |
| 3,646,724 | 2/1972 | Peck | 55/274 |
| 3,785,118 | 1/1974 | Robertson | 55/154 |
| 3,800,509 | 4/1974 | Carr et al. | 55/131 |
| 4,124,359 | 11/1978 | Geller | 55/130 |
| 4,182,673 | 1/1980 | Schmidt et al. | 209/45 |
| 4,405,342 | 9/1983 | Bergman | 55/6 |
| 4,699,681 | 10/1987 | Kasmark | 55/387 |
| 4,726,812 | 2/1988 | Hirth | 55/123 |

FOREIGN PATENT DOCUMENTS

| | | | |
|---|---|---|---|
| 866764 | 9/1941 | France | 55/130 |

*Primary Examiner*—Bernard Nozick

*Attorney, Agent, or Firm*—William R. Clark; Richard M. Sharkansky

[57] ABSTRACT

An air filter and particle removal system for eliminating impurities from air. The system is constructed with an upper electrode plate facing a lower electrode plate. A flypaper-like material is placed close to the lower plate with the sticky side of the material facing the upper plate. The plates have different voltage polarities so that when air is passed through the duct, charged particles within the air will move toward the lower plate and are caught by the flypaper-like material. Further, the upper plate is shaped to create turbulences in the air to cause other impurities to flow over and be caught by the flypaper-like material.

13 Claims, 3 Drawing Sheets

AIR FILTER AND PARTICLE REMOVAL SYSTEM

This application is a continuation of application Ser. No. 342,151 filed Apr. 24, 1989 now abandoned.

BACKGROUND OF THE INVENTION

The present invention relates to method and apparatus for filtering particles from the air, and more particularly to an electrostatic filter including a material which catches the air particles and other impurities that flow through the system.

Many contaminants are present in air. These contaminants include dust particles, odors, viruses, hair, bacteria, etc. These contaminants when inhaled can cause illnesses such as asthma, colds and the flu. Also present in the air is radon. Radon contains charged particles that attach to dust particles. These particles may be inhaled into the body and adsorbed into the lungs. When the radon particles decay, they emit radiation which may alter or destroy cells and cause cancer. Accordingly, it is desirable to remove these contaminants from the air.

Numerous methods and apparatuses are known and utilized to remove air borne contaminants from air streams. One such apparatus is an electric precipitator which involves a two-step process to remove the particles suspended in the air stream. In the first step, the particles pass through an electric discharge area to ionize the air. The ions so produced collide with the suspended particles and confer on them an electric charge.

In the second step in this process, these charged particles are precipitated on electrode plates that have a high voltage gradient imposed therebetween. Efficiency of these electric precipitators is limited by the resistance of the dust to be collected, the area of the collector plate relative to the volume of air cleaned, and the amount of charge on the dust to be collected. Dust particles to be precipitated must generally have resistivities between $5\times10^3$ and $2\times10^{10}$ ohms per centimeter. Outside this range, particles cannot be efficiently collected, which therefore significantly restricts the electric precipitator application. Further, electrostatic precipitators remove only particulate matter, and not objectionable gases. These apparatuses are also subject to the disadvantages that the charges applied to the surfaces of the belts are susceptible of being pulled off the belts by charged dust particles.

A further difficulty associated with this type of apparatus is that the particles are subject to reintrainment. Upon contacting the collection surface, the particles may either be neutralized or reversed in polarity depending on the strength of the charge imparted to the belt. In either event, they are susceptible to being dislodged from the belt surface by motion of the gas stream, or by the attractive forces of the oppositely charged dust carried by gas stream, because the restrain of the belt primarily by non-electrical affects.

Moreover, the cleaning of the collection plates of the prior art systems presents a serious problem in so much as a substantial amount of the reintrainment of the dust occurs. Removal of the dust from the plates is normally accomplished by vibrating the collection plates to dislodge dust particles which fall by gravity into hoppers located beneath the plates. Because of the proximity of the plates to the gas flow channel, however, some of the dislodged dust particles are reintroduced into the gas stream. These particles must be recharged and again collected for effective removal from the stream. This necessitates a lengthening of the collection zone to compensate for reintrainment of the particles during the removal operation. Exemplary electric precipitators are disclosed in U.S. Pat. Nos. 2,579,440; 3,581,468; and 3,626,668.

Another type of apparatus frequently used to remove air borne contaminants is a filter, designed as an assembly containing very small obstacles such as fibers intricately bound together or loosely bound hygrogate through which the dirty air flows. The mechanical filter captures particles because the particles inertia and diffusion causes a collision with the filter media, although the collection efficiency for a large number of collectors in the typical filter medium is very high. Unfortunately, the large collection area in these mechanical filters also produces higher restrictions to air flow than electric precipitators. Restrictions on air flow reduces the rate at which air can be filtered. Further, these mechanical filters may not always be able to filter out small particles within a gas stream. Also, these filters must be frequently changed, as they fill up with dust particles.

An improvement in filter performance is realized by electrifying the filter medium to increase filter efficiency and filter life. These filters are based upon the concept of either charging or polarizing a filter medium generating an electric force between the medium and the particles.

Compared to a conventional filter, the electrofiberous filter has a much higher efficiency. When an external electric field is first applied to the filter medium, the capture mechanism is due to the forces between the polarized medium and the polarized or charged particles. The electric field instantly polarizes the filter medium, which then attracts both charged and polarized particles. Examplary electric filters are disclosed in U.S. Pat. Nos. 3,800,509; 3,375,638; 3,537,238; and 4,405,342.

The electric filters disclosed in the preceding patents have air that flows through the filter medium. This blockage of air flow can reduce the amount of time that the air filter may take to remove all the particles from a room. Further, non-charged particles may not be ionized and would thereby not be filtered. Further, these devices remove small particles but may not be able to remove the larger particles from the air. Finally, these devices may not be able to remove odors from the air without restricting the air flow.

One such device that is used to collect particles larger than a pre-selected size from a particle laden air stream is disclosed in U.S. Pat. No. 4,182,673. This device uses an inertial impaction to separate particles larger than a specified size from smaller particles in an air stream. The device collects these particles on a moving adhesive collection surface. With this device, the collection surface moves in a direction opposing the air stream. A drawback of this device is that the air stream speed may have to be lowered so that the particles will adhere to the collection surface. Another drawback of this device is that odors in the gases that pass through the device will not be eliminated. Further, only large particles may be removed from this device and not the smaller particles.

SUMMARY OF THE INVENTION

One object of this invention is to provide an improved air filter and particle removal system.

Another object of this device is to remove small and large particles from gases or the like.

An additional object of this device is to filter particles without blocking air flow.

Another object of this invention is to filter charged and non-charged particles from the air.

An additional object of this invention is to provide a particle removal system that removes odors as well as particles from the air stream.

It is also an object of this invention to provide a device that filters positively and negatively charged particles from the air.

It is also an object of this invention to provide a device that traps the particles in a manner so that the device can be easily cleaned.

It is another object of this invention to provide a particle removal device that has a filter that does not require frequent changing.

These and other objects are provided in accordance with the invention which defines an apparatus for removing charged and non-charged particles from gas, the apparatus comprising a first electrostatic plate having a first surface at a first potential voltage, and a second electrostatic plate having a surface opposing the first surface at second potential voltage. The apparatus comprises means for passing gas between the first and second plates and means for changing the potential on one of the surfaces so that charged particles within the gas and on the first surface will move toward the second surface. Once the particles move toward the second surface and contact the second surface, the particles adhere to a means for catching the particles on the second surface. By having these particles caught by the catching means, they are removed from the gas. Hence, particle-free gas is discharged from the apparatus. It may also be preferable that the apparatus further comprise means for moving said gas passing between the first and second surface toward the second surface so that the non-charged particles contact the catching means and are further removed from the gas stream. It may also be preferable that the first electrostatic plate be shaped to cause turbulences in the passing gas so that non-charged particles contact the catching means and are removed from the gas. It may also be preferable that the surface of the catching means move in the opposite direction to the gas passing between the first and second surface so as to expose a new surface of the catching means to collect the particles and so that the particles will have a longer time period in which to contact the catching means. Additionally, it may be preferable that the catching means contains carbon particles to filter said passing gas and remove the odor from the gas.

Alternately, the invention may be practiced with an apparatus for removing particles from a gas stream comprising a collecting means having a first surface for collecting and retaining particles impinged thereon, a second surface facing the first surface being shaped to cause turbulences in the gas stream so that the particles in said gas contact the collecting means, and means for enclosing the first and second surface. The apparatus has an inlet means within said housing for directing the gas stream between the first surface and the second surface and outlet means within the housing for venting the gas stream after flowing between the first and second surface, thereby removing substantially all the particles from the gas stream and dispersing clean air into the surrounding room. It may be preferable that the inlet means be shaped to direct the gas stream into the second surface before gas contacts the collecting means. It may further be preferable that the first surface contains means for adsorbing odor in the gas.

The invention may further be practiced by a method of removing charged and non-charged particles from a gas stream comprising the steps of charging a first plate having a surface to a potential voltage, charging a second plate, having a surface facing the surface on the first plate, to a potential voltage different from the first plate potential voltage, passing the gas stream between the first and second plate, changing the potential on one of the plates to make the charged particles move toward the second plate, and catching the particles that move toward the second plate with a catching means. This method will thereby filter particles from a gas or air stream. It may be preferable that this method comprise the step of causing turbulences within the gas passing between the first and second plate to make non-charged particles to contact the catching means. It may further be preferable that the method further comprise the step of changing the potential of one of the plates to make the charged particles move toward the first plate, thereby preventing the particles gathering on the first plate and be collected on the catching means. The method may also be practiced by the step of adsorbing odors in the gas as it flows between the first and second plate. The method may further be practiced by moving the catching means in the opposite direction to the gas stream while the gas flows between the first and second plate to increase the dwell time of the gas and to give the particles a greater opportunity to be collected by the catching means.

DETAILED DESCRIPTION OF THE PREFERRED EMBODIMENTS

Figure 1:
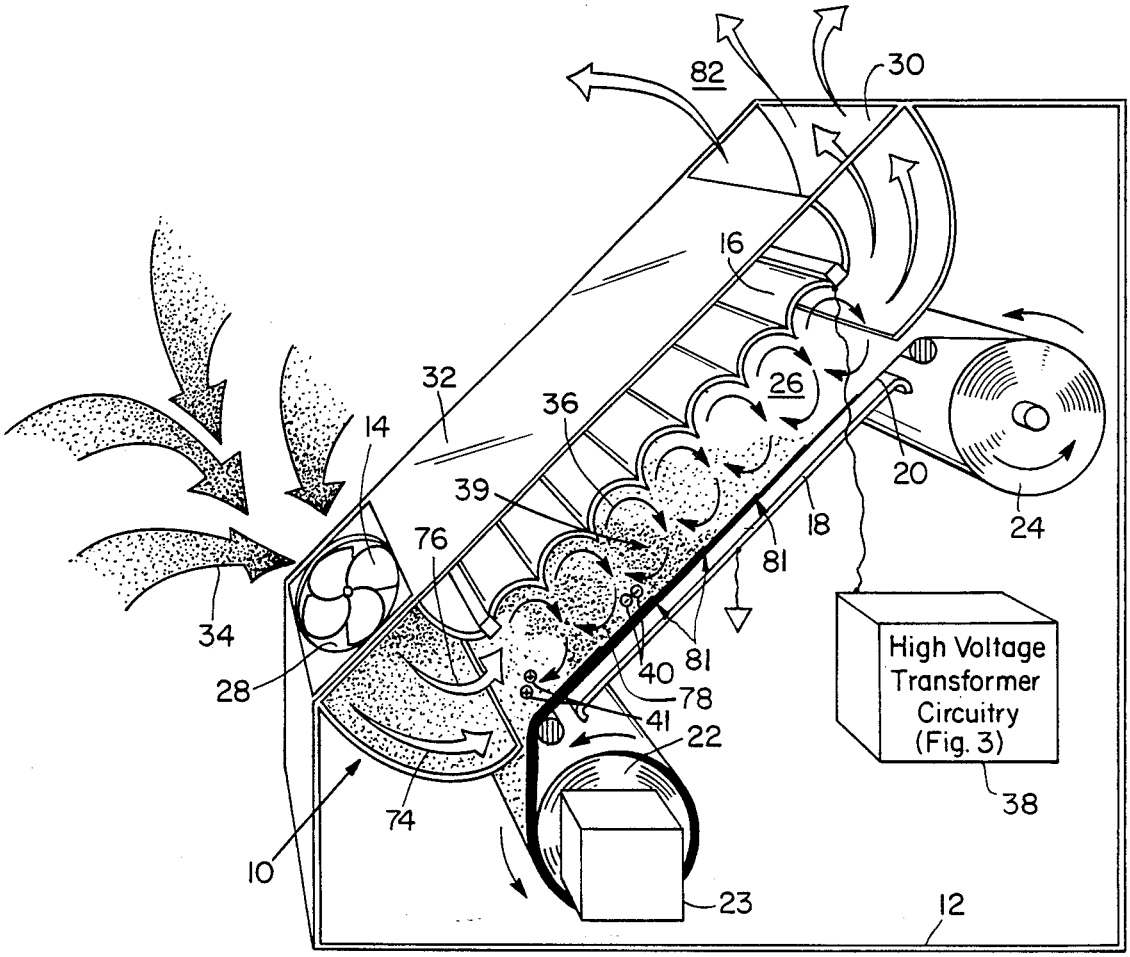
FIG. 1 illustrates a side view of the air filter and particle removal system in a stand-alone configuration.

Referring to FIG. 1, there is shown the air filter and particle removal system 10 disposed within a stand alone housing 12. This removal system 10 includes an intake fan 14, an upper electrode plate 16 facing a lower electrode plate 18, and adhesive paper 20 resting on the lower electrode plate 18. Adhesive paper 20 is suspended between a take-up roll 22 and supply roll 24. Take-up roll 22 is attached to a take-up drive motor 23. The upper electrode plate 16 and lower electrode plate 18 are located in chamber 26. At one end of chamber 26 is inlet 28 and at the other end is outlet 30.

The upper electrode plate 16 and lower electrode plate 18 are preferably made from an electrically conductive material such as metal and are electrically isolated from stand alone housing 12.

The inlet 28 is also located near one end of the electrode plates 16 and 18 and on the top surface 32 of the stand alone housing 12. The outlet 30 is located on the top surface 32 of the stand alone housing 12 at the other end of the electrode plates 16 and 18.

Disposed adjacent the inlet 28 is an intake fan 14 which circulates air or gas 34 through the chamber 26 to the outlet 30. The upper electrode plate 16 is formed in the shape of a clam shell or equivalent to cause turbulence 36 in the air as it flows through the chamber 26. The electrode plates may be shaped like a foils, sine waves, etc. to force the air and particles 39 toward the lower electrode plate 18. Particles 39 may be charged or non-charged.

The distance between upper electrode plate 16 and lower electrode plate 18 is preferably less than one inch. Hence, an electric field forms between the upper electrode plate 16 and lower electrode plate 18. High voltage transformer circuitry 38 is connected to the upper electrode plate 16. The lower electrode plate 18 contacts the adhesive paper 20 and is connected to ground. The high voltage transformer 38 supplies alternating negative and positive electric potentials to the upper electrode plate 16. These electric potentials are supplied for predetermined time intervals which will be explained in more detail in connection with FIG. 3 and 4.

As is well known in physics, like charges repel and unlike charges attract. Accordingly, applying a more positive electric potential on upper electrode plate 16 than on lower electrode plate 18 causes negatively charged particles 40 within the air in chamber 26 to migrate toward lower electrode plate 18. Applying a more negative electric potential on upper electrode plate 16 than lower electrode plate 18 causes positively charged particles 41 to migrate toward lower electrode plate 18. By alternating the polarity of the electric potential on upper electrode plate 16 with respect to lower electrode plate 18, both positive and negative charged particles 40 and 41 will migrate toward lower electrode plate 18.

The adhesive paper 20 suspends between the take-up roll 22 and supply roll 24. Adhesive paper 20 contains material which will collect and hold particles 39 and charged particles 40 and 41 as they move from the upper electrode plate 16 toward the lower electrode plate 18. The adhesive paper 20 also contains material to adsorb odor in the air.

Figure 2:
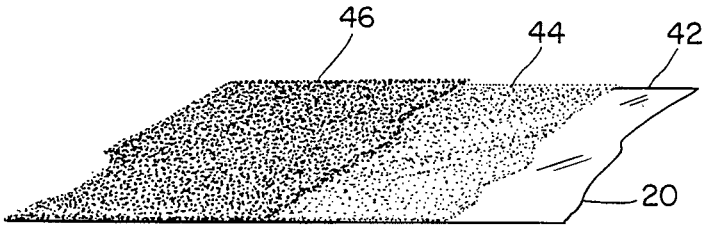
FIG. 2 illustrates a side sectioned view of the filter paper used in the particle removal system.

Referring to FIG. 2, the adhesive paper 20 has three layers; the first which contains paper 42, the second which has an adhesive material 44 stuck to the paper 42, and the third layer has scattered carbon particles 46. It is preferable that paper 42 be constructed of sufficient strength so as to withstand forces of the take-up drive motor 23 without tearing. Although paper material is preferred, other substances may be substituted such as plastic or cellophane. It is preferable that the adhesive paper 20 be wide enough to extend across the surface of the lower electrode plate 18. The adhesive material 44 on paper 42 should be sticky to collect small and large particles. An example adhesive is found on ordinary Scotch ® tape. The sticky side of the adhesive paper 20 faces upward toward the upper electrode plate 16. The scattered carbon particles 46 rest on the adhesive material 44 and are preferably scattered throughout the adhesive paper 20 in small clumps.

Referring to FIG. 1, the take-up drive motor 23 constantly rotates take-up roll 22 at a speed that will prevent a large amount of charged particles 40 from building up on the adhesive paper 20. It is preferable that the length of the supply roll 24 be large enough to prevent frequent servicing and replacement of the adhesive paper 20. The adhesive paper 20 slides along lower electrode plate 18 at a speed slow enough to prevent frequent changing of the adhesive paper 20. The take-up drive motor 23 speed may be adjustable to cause fast movement in a dust laden environment and a slow movement in a dust free environment. Preferably, the supply roll 24 will contain 365 feet of adhesive paper 20, and the adhesive paper 20 will slide along lower electrode plate 18 at a rate of 1 foot per day. Accordingly, the adhesive paper 20 will only need to be replaced once a year.

Figure 3:
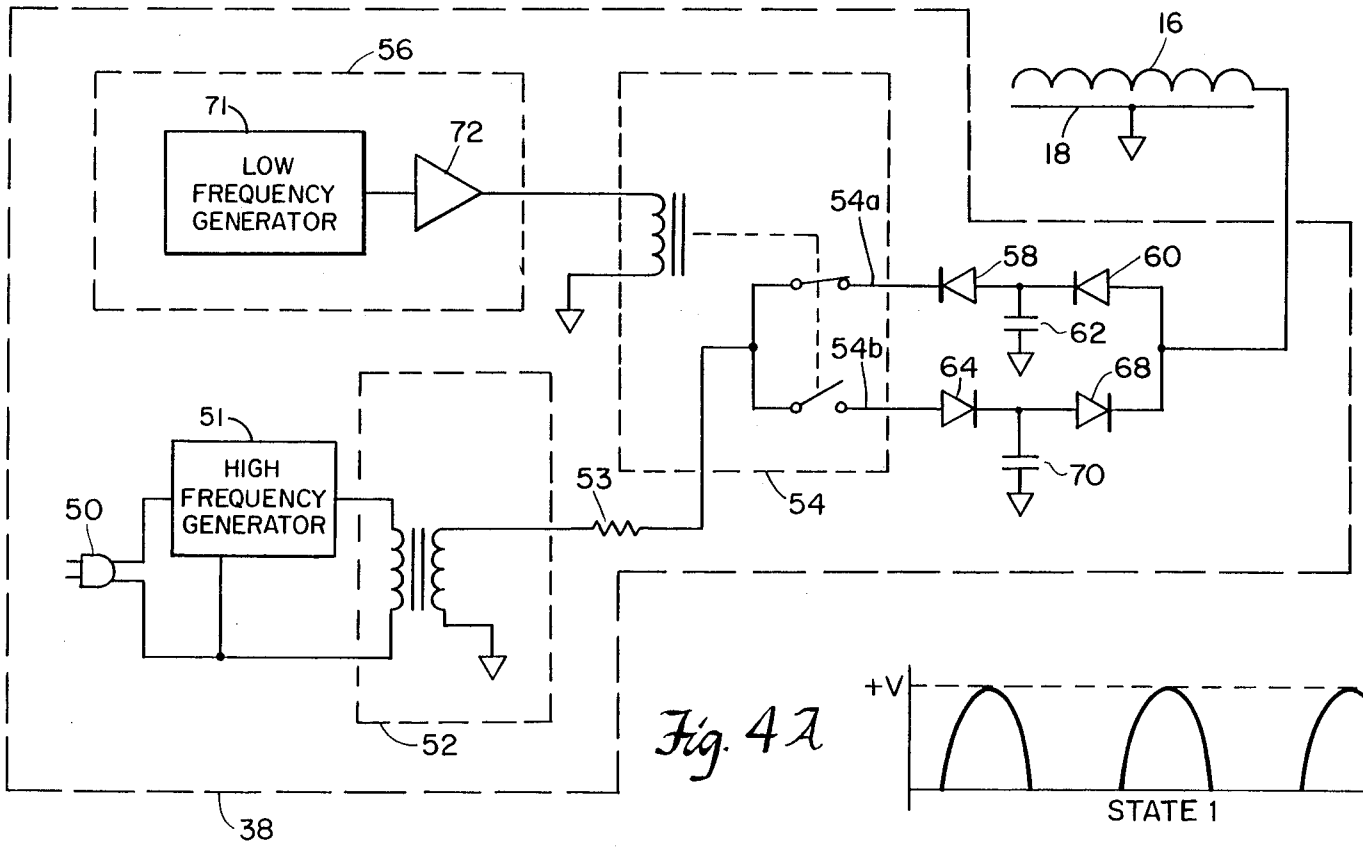
FIG. 3 illustrates a schematic of the electrical system for the air filter and particle removal system.

Referring to FIG. 3, there is shown a schematic diagram of the high voltage transformer circuitry 38 which provides an electric potential to the upper electrode plate 16. This transformer circuitry 38 includes a 120 volt AC line 50 connected through high frequency generation circuitry 51 to a high voltage transformer 52. High frequency generation circuitry 51 includes a DC power supply, an oscillator chip and an amplifier (not shown). High frequency generation circuitry 51 generates an oscillating signal, preferably alternating at 20 KHz. The high voltage transformer 52 transforms the oscillating signal output to 3,000 to 4,000 volts. The high voltage output of the high voltage transformer 52 is connected through resistor 53 to a high voltage reversing relay 54 that is controlled by timing and control logic circuitry 56. The output of the high voltage reversing relay 54 has two terminals, **54*a* and 54*b*. Terminal 54*a* is connected through two negatively biased diodes 58 and 60 to the upper electrode 16. Between the negatively biased diodes 58 and 60 is a high voltage capacitor 62 connected to ground. Connected to the 54*b* terminal are two serially connected diodes 64 and 68 which are also connected through a high voltage capacitor 70 to ground. The high voltage reversing relay 54 is a break before make relay that selects whether a positive (terminal 54*a* is enabled) or negative (terminal 54*b* is enabled) electric potential will be distributed to the upper electrode plate 16. The lower electrode plate 18** is electrically connected to ground.

The timing and control logic circuitry 56 contains low frequency generation circuitry 71 which sets the amount of time that either a positive or a negative voltage potential will be present on the upper electrode 16. The timing control logic circuitry 56 contains an amplifier 72 which drives the high voltage reversing relay 54. The reversing relay 54 turns off and on in response to amplifier 72 output. This timing and control logic circuitry 56 uses standard TTL logic.

The high voltage reversing relay 54 reverses the polarity of the electric potential on upper electrode 16 at a rate preferably between two times per second and once every two seconds. The rate that the relay reverses would be set in accordance with the rate of the air flow through cavity 26. An increase in the relay reversal rate would increase the number of times a particle moves from the upper electrode plate 16 toward the lower electrode plate 18. With a high flow rate through chamber 26, it is preferable that the relay reversal rate be higher than with a low flow rate. It is recognized that with a high flow rate, raising the reversal rate will increase the probability that particle will contact the adhesive paper 20.

Figure 4A:
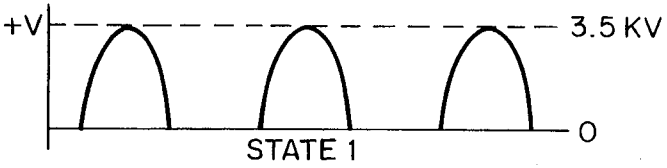
FIG. 4A illustrates the voltage level of the upper electrode plate during State 1.
Figure 4B:
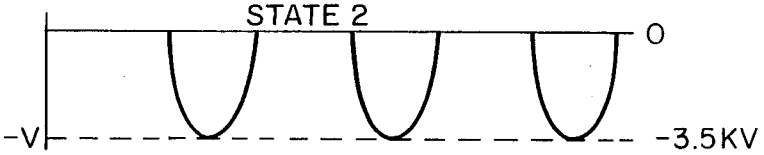
FIG. 4B illustrates the voltage level of the upper electrode plate during State 2.

Referring to FIG. 4A, there is shown the electric potential across the upper electrode 16 when terminal **54*a* is enabled (state 1). Referring to FIG. 4B, there is shown the electric potential across the lower electrode plate 16 and when terminal 54***b* is enabled (state 2). As stated previously, the electric potential fluctuates between 0 and 3,500 volts on terminal 54*a*, and between 0 and −3,500 volts on terminal 54*b*. Alternately, other transformer circuitry may be used to provide DC voltages to high voltage reversing relay 54 to change from the electric potential across the upper electrode plate 16.

Referring to FIG. 1, during operation, the intake fan 14 is turned on and air 34 flows from the surrounding room through inlet 28 into chamber 26. As the air flows into chamber 26, it moves in a downward direction 74 and then in an upward direction 76 against the upper electrode plate 16. Because of the shape of the upper electrode plate 16, backward turbulences 78 are created within the air in chamber 26. These turbulences result in the air flowing across the adhesive paper 20. It is recognized that as the air flows across the adhesive paper 20, particles 39 within the air will bond to the adhesive material 44. It is further recognized that the odorous gases that flow across the adhesive paper 20 will be adsorbed by the scattered carbon particles 46.

The take-up drive motor 23 turns take-up roll 22 which pulls the adhesive paper 20 in the direction opposite to the air flow through the chamber 26. It is recognized due to the backward turbulences 78 in the air caused by the shape of the upper electrode plate 16, the air moves across the adhesive paper 20 having a dwell time that is greater than that which would have occurred had there been no turbulence.

As the air flows through the chamber 26, the air continues to circulate in the upper electrode plate 16, continuing to generate turbulence 36 as the air moves toward the outlet 30. As seen in FIG. 1, particles 40 bond to adhesive paper 20 and are removed from the air. Eventually when the air reaches the outlet 30, cleaner air 82 is exhausted back into the surrounding room.

In addition to turbulence 36 being generated within the chamber 26, the electric potential of the upper electrode plate 16 with respect to the lower electrode plate 18 changes, as shown in FIG. 4. These electric fields, in combination with the closeness of the plates, result in charged particles 40 and 41 migrating from upper electrode plate 16 toward lower electrode plate 18. It is observed that as these charged particles 40 and 41 migrate between the electrode plates 16 and 18, the adhesive paper 20 collects the charged particles 40 and 41. It is recognized that the positively charged particles 41 are further attracted to the adhesive paper 20 when the adhesive paper 20 is negatively charged with respect to the upper electrode plate 16 and the negatively charged particles 40 are attracted to adhesive paper 20 when adhesive paper 20 is positively charged with respect to upper electrode plate 16. It is also recognized that particles 39 may be either charged positively, negatively, or may be polarized. By changing the electric potential on the upper electrode plate 16 with respect to the lower electrode plate 18, both positively charged and negatively charged particles 40 and 41 will migrate toward the lower electrode plate 18 and will be caught by the adhesive paper 20. Due to particles detaching from the upper electrode plate 16 and attaching to adhesive paper 20, to clean the air filter and particle removal system 10, only the take-up roll 22 need be removed and replaced.

The electric field is strongest at the locations in the cavity where the distance between the upper and lower electrode plates 16 and 18 are at a minimum (locations 81). These locations 81 are where the majority of charged particles will first attach to the adhesive paper 20. It is observed that by generating backward turbulences 78 while an electric field is being generated, the dwell time of the charged particles 40 and 41 within the chamber 26 is increased, thereby allowing more time for the electric fields between the electrode plates 16 and 18 to move the charged particles 40 and 41 toward the adhesive paper 20. Additionally, this increase in dwell time will increase the probability that particles 40 and 41 will be caught by adhesive paper 40. This particle migration substantially eliminates all particles from flowing out outlet 30.

Figure 5:
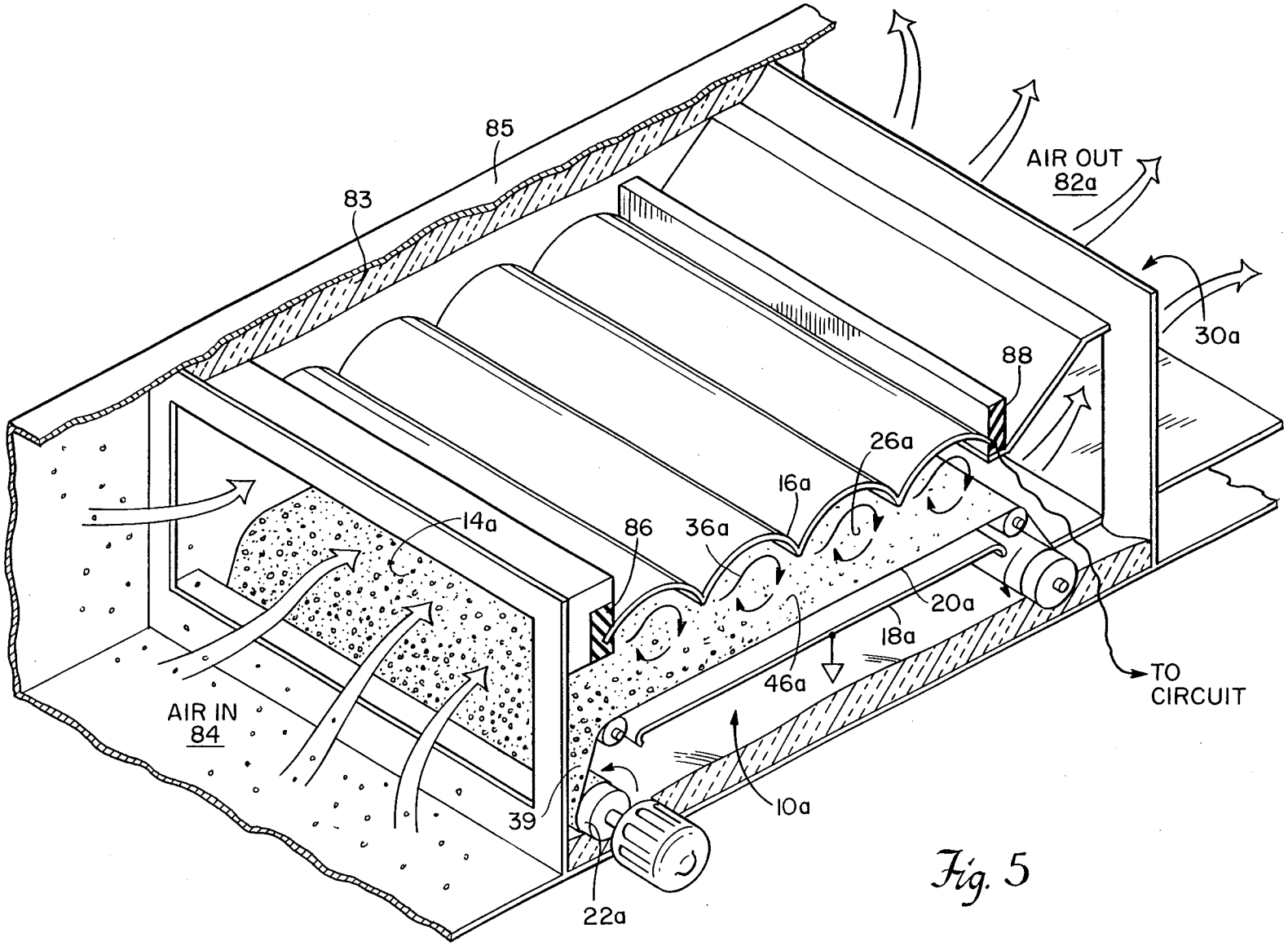
FIG. 5 illustrates a perspective view of the air filter and particle removal system for use in an air conditioner heating duct.

Referring to FIG. 5, there is shown an air filter and particle removal system 10*a* that may be embedded within a heat or air conditioned duct (not shown). Particle removal system 10*a* operates similarly to the system in FIG. 1. This particle removal system 10*a* is disposed within housing 85. Between system 10*a* and housing 85 is insulation 83. The system 10*a* requires a wide upper and lower electrode plates 16*a* and 18*a* and wide adhesive paper 20*a*. The air 84 moves through the removal system 10*a* by first entering inlet 14*a*, then cavity 26*a* and out outlet 30*a*. The air 84 is pushed by an external fan (not shown) such as a blower used in heating or air conditioning systems. Turbulences 36*a* are generated throughout the chamber 26*a* due to the shape of upper electrode plate 16*a*. The upper electrode plate 16*a* is electrically insulated from housing 85 with insulation blocks 86 and 88. Upper and lower electrode plates 16*a* and 18*a* are connected to the circuitry shown in FIG. 3. During operation, particles 46*a* migrate toward the lower electrode plate 16*a* and bond to adhesive paper 20*a*. The adhesive paper 20*a* containing particles is pulled onto take up roll 22*a*. Take up roll 22*a* rotates at a rate sufficient to prevent a large build up of particles 39*a* on the surface of the adhesive paper 20*a*. Exiting outlet 30*a* is substantially clean air 82*a*.

This concludes the Description of the Preferred Embodiments. A reading of those skilled in the art will bring to mind many modifications and alternatives without departing from the spirit and scope of the invention. Accordingly, it is intended that the invention only be limited by the following claims.

What is claimed is:

1. An apparatus for removing charged particles from gas, said apparatus comprising:

a first electrostatic plate having a first surface;

a second electrostatic plate having a second surface opposing said first surface;

means for directing said gas between said first and second surfaces;

means for providing said first plate with an electric potential of alternating polarity with respect to said second plate to move charged particles within the gas toward said second surface; and said providing means comprising means for varying the rate at which said polarity is alternated.

2. The apparatus as recited in claim 1 further comprising adhesive paper means disposed between said first and second surface for catching said particles that move toward said second surface.

3. The apparatus as recited in claim 2 further comprising means for moving said adhesive paper means in direction opposite to which said gas is directed between said first and second surface so as to expose a new surface of said adhesive paper means to said particles.

4. The apparatus as recited in claim 2 wherein said adhesive paper means contains carbon particles to filter said gas passing between said first and second plates.

5. The apparatus as recited in claim 2 further comprising means for directing said gas passing between said first and second surfaces toward said second surface wherein any non-charged particles in said gas contact said adhesive paper means.

6. The apparatus as recited in claim 3 wherein said first electrostatic plate is shaped to cause turbulences in said passing gas so that said non-charged particles contact said adhesive paper means.

7. An apparatus for removing particles from a gas stream comprising:

an adhesive paper having a first surface, said adhesive paper having means for collecting and retaining particles impinged thereon;

a plate having a second surface facing said first surface;

means for enclosing said first and second surface;

inlet means within said enclosing means for directing said gas stream between said first surface and said second surface;

said plate having a shape comprising means for providing turbulences of said gas stream wherein particles within said gas stream are directed toward said adhesive paper;

outlet means within said enclosing means for venting said gas stream after flowing between said first and second surface; and means for moving said adhesive paper through said enclosing means.

8. The apparatus as recited in claim 7 wherein said inlet means is shaped to direct said gas stream into said second surface before said gas is directed toward said adhesive paper.

9. The apparatus as recited in claim 7 wherein said adhesive paper contains means for adsorbing odor in said gas.

10. The method of removing charged particles from a gas stream comprising the steps of:

providing a first plate having a first surface;

providing a second plate having a second surface facing said first surface of said first plate;

directing the gas stream between said first and second surfaces of said first and second plates;

providing said first plate within an alternating polarity electric potential with respect to said second plate to move said charged particles in said gas toward said second plate;

varying the rate of alternating said polarity of said electric potential in accordance with the rate said gas stream is directed between said first and second plates; and providing an adhesive paper disposed over said second plate to catch said particles.

11. The method as recited in claim 10 further comprising the step of causing turbulence within said gas stream between said first and second plates to direct any noncharged particles in said gas to contact said adhesive paper.

12. The method as recited in claim 10 further comprising the step of adsorbing odors in said gas with said adhesive paper as said gas stream flows between said first and second plate.

13. The method as recited in claim 10 further comprising the step of moving said adhesive paper in the opposite direction to the gas stream while said gas flows between said first and second plate.

* * * * *